US006112347A

United States Patent [19]

Tharalson et al.

[11] Patent Number: 6,112,347

[45] Date of Patent: Sep. 5, 2000

[54] MULTI-PURPOSE BEDSIDE CO-SLEEPER

[76] Inventors: Douglas Tharalson; Diana M. Tharalson, both of 29995 Mulholland Hwy., Agoura, Calif. 91301

[21] Appl. No.: 09/244,140

[22] Filed: Feb. 4, 1999

[51] Int. Cl.[7] ..... A47D 7/04

[52] U.S. Cl. ..... 5/95; 5/2.1; 5/93.1; 5/93.2; 5/97

[58] Field of Search ..... 5/2.1, 93.1, 93.2, 5/95, 17, 98.1, 655

[56] References Cited

U.S. PATENT DOCUMENTS

| | | | |
|---|---|---|---|
| 2,291,233 | 7/1942 | Karlik | 5/93.1 |
| 3,427,666 | 2/1969 | Saxe | 5/2.1 |
| 5,845,349 | 12/1998 | Tharalson | 5/99.1 |

*Primary Examiner*—Terry Lee Melius
*Assistant Examiner*—Fredrick Conley
*Attorney, Agent, or Firm*—David A. Belasco; Beehler & Pavitt

[57] ABSTRACT

A bedside crib (hereinafter "co-sleeper") that attaches to the parental bed that may be easily converted for use as a child's easel, couch, bassinet or toy display/storage device. The co-sleeper provides a rigid enclosure formed of a pair of sides, front and rear leg portions, a removable back, a mattress base with front retaining lip, and at least one removable shelf. The mattress base is hingedly attached to the front leg portion to tilt upwardly at an acute angle to a ground surface to serve as a child's easel. When the mattress base is tilted at a right angle to the ground surface and the back of the co-sleeper is removed, the latter may serve as a toy storage/display device. A removable front allows the enclosure to function as a bassinet. Height-adjustable leg extensions attach to the sides to adjust the co-sleeper to different heights for use with various beds and to raise or lower the co-sleeper for use in alternative modes (bassinet, couch, etc.). The removable shelves attach in different positions using various mounting holes in the sides. A mattress pad is used with the invention as a co-sleeper and a couch pad is used with the device as a small couch. A strapping member and retaining plate secure the co-sleeper to the parental bed. A removable base plate mounts beneath the mattress and above a shelf to provide an enclosed storage space below the mattress base. An art supply holder is removably mounted to the front retaining lip.

15 Claims, 5 Drawing Sheets

Fig. 1
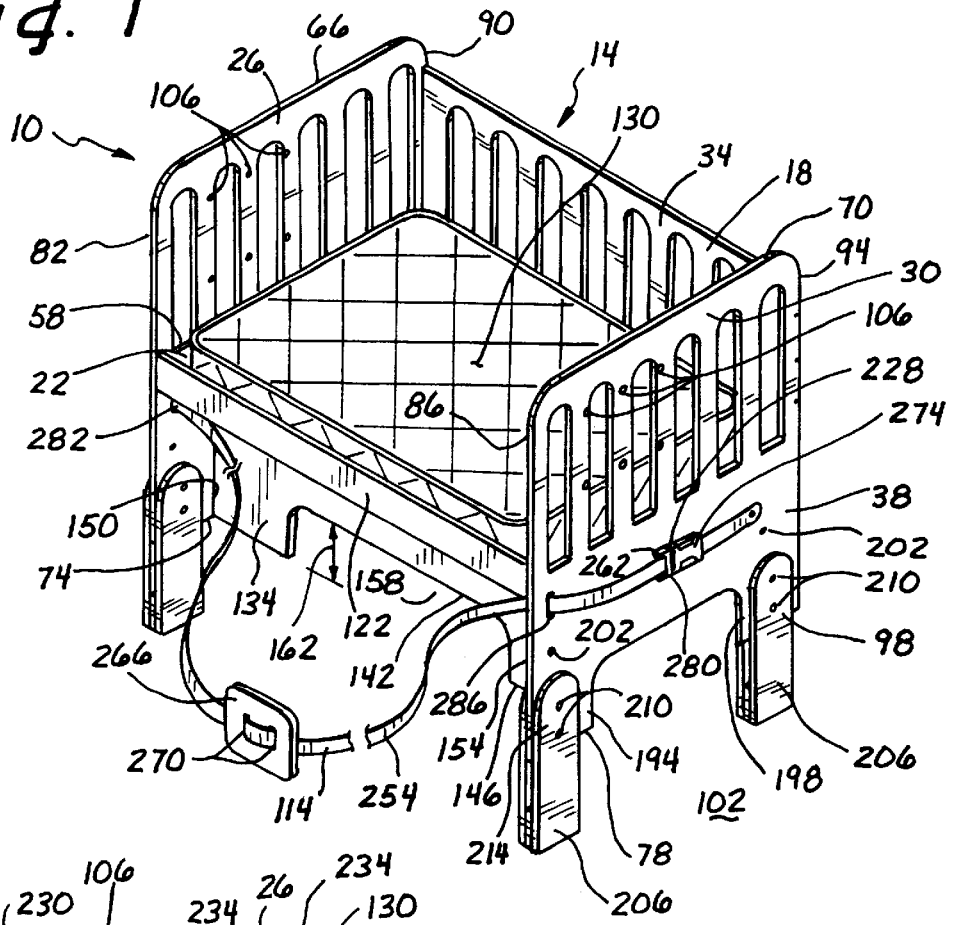
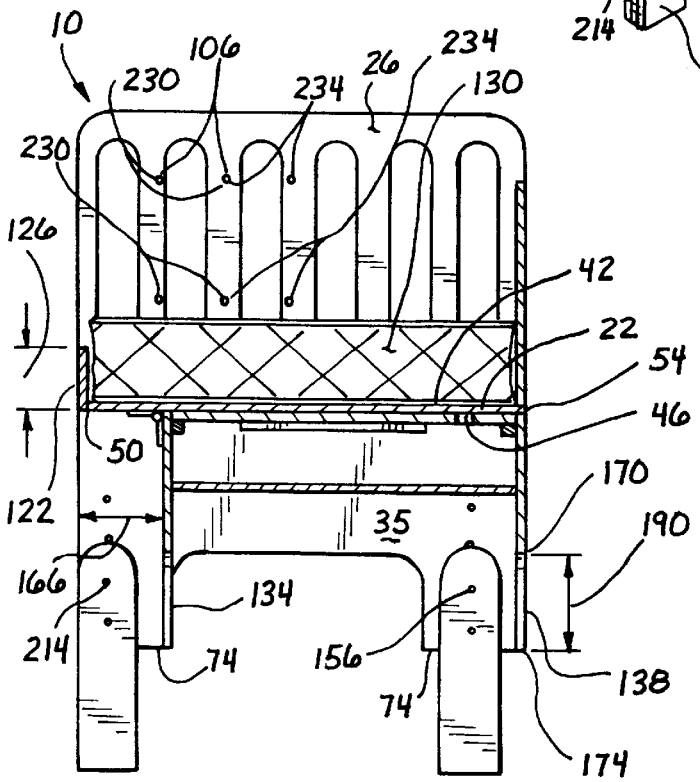
Fig. 2

Fig. 3
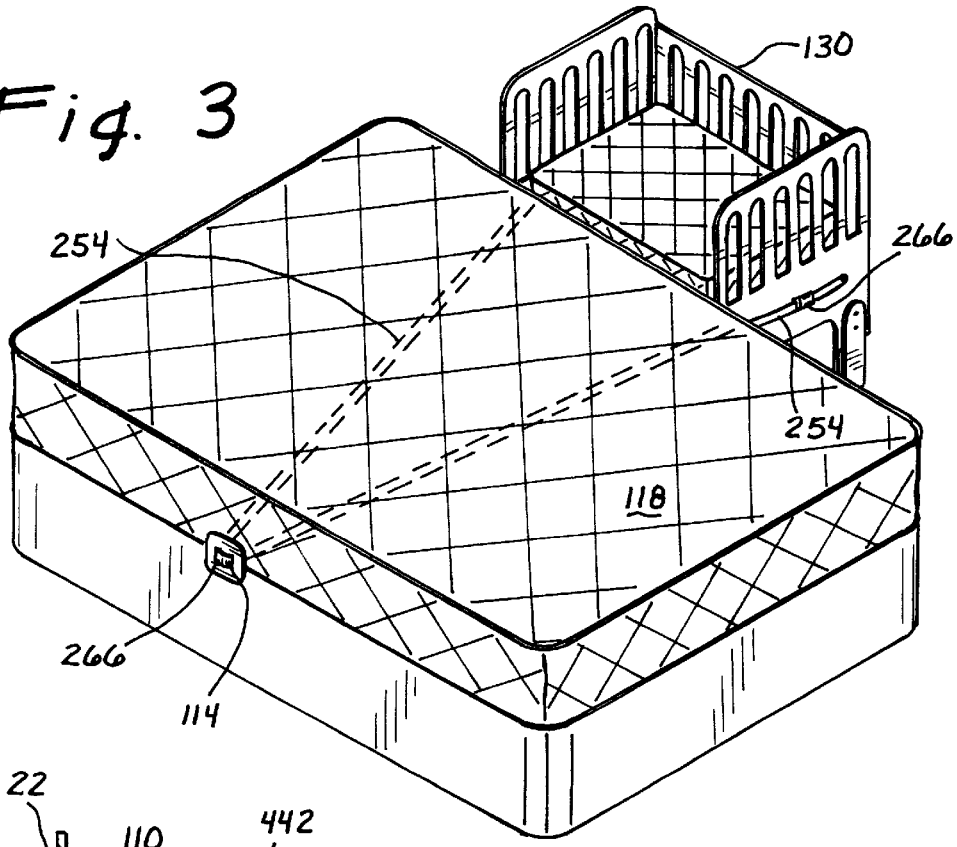
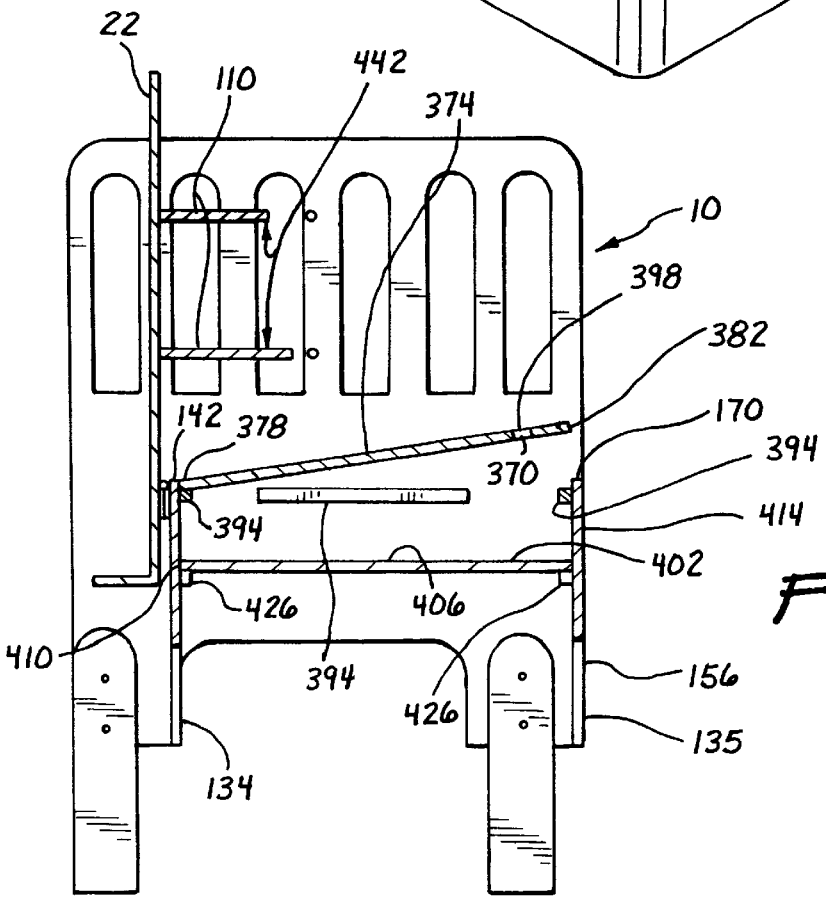
Fig. 6

Fig. 7
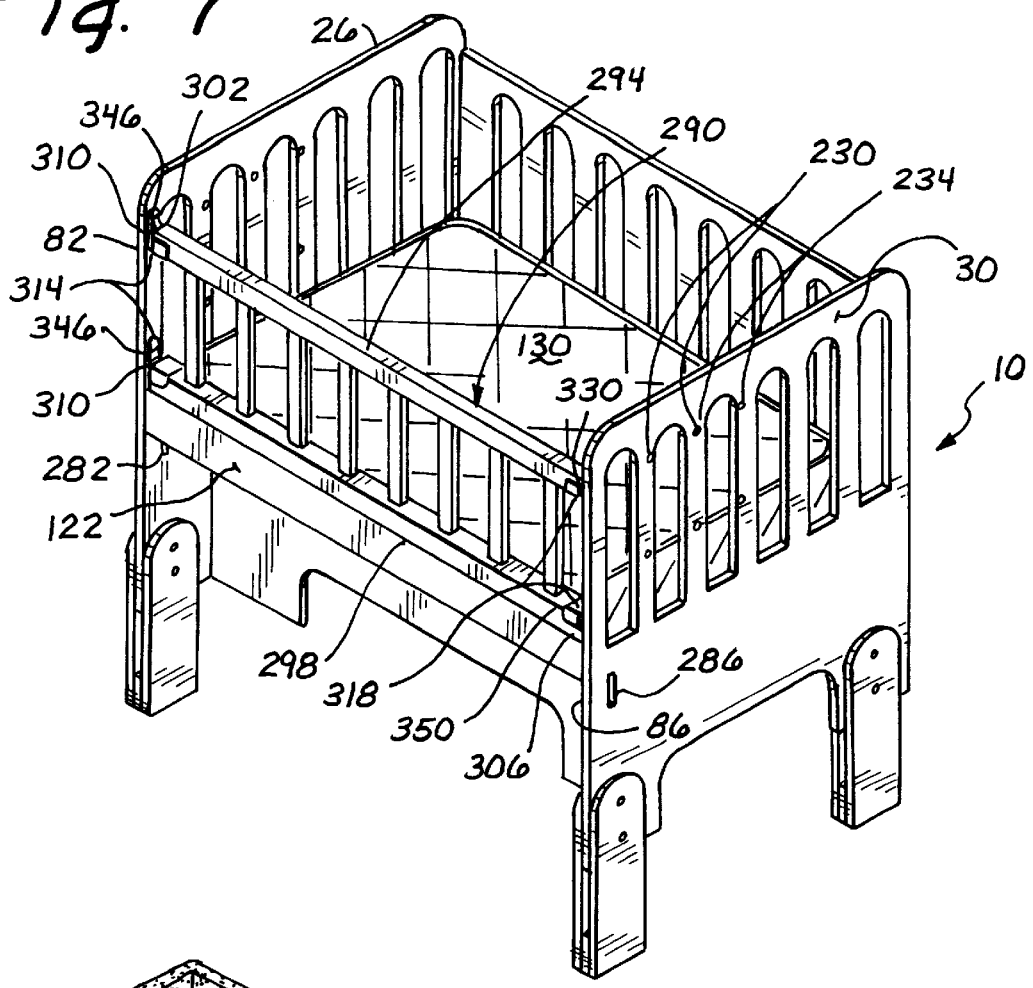
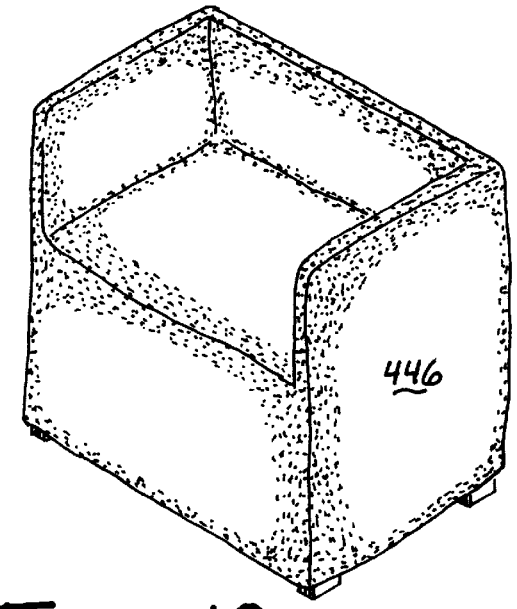
Fig. 10
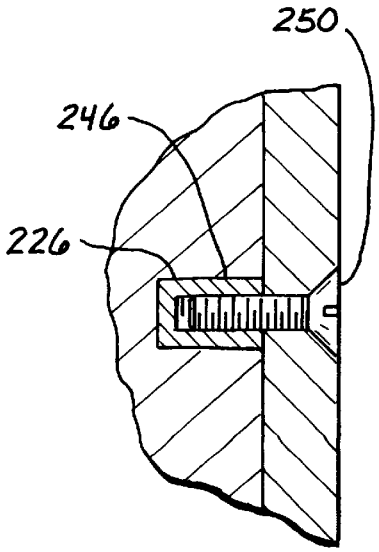
Fig. 11

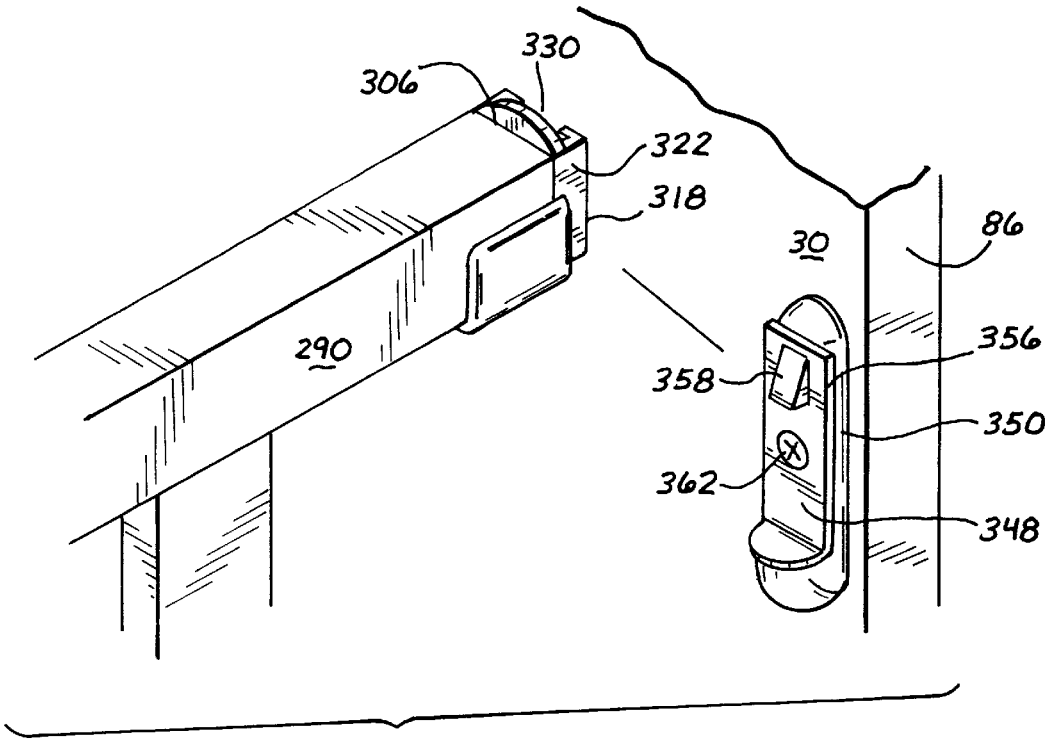
Fig. 8
Fig. 9
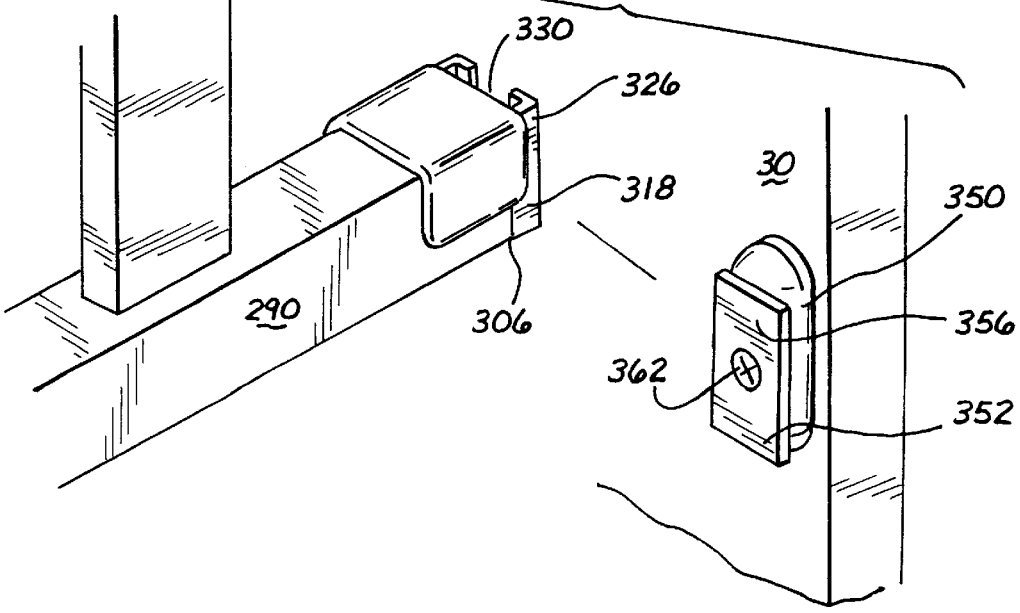

MULTI-PURPOSE BEDSIDE CO-SLEEPER

FIELD OF INVENTION

The instant invention relates to the field of convertible units for use with babies and very young children. In particular to units that may be easily converted to an easel, toy storage and display unit or child's bed-side sleeping enclosure, hereinafter referred to for convenience as a "co-sleeper", that attaches securely to the parents' bed.

BACKGROUND OF THE INVENTION

Furniture and fixtures for use by babies and small children often presents a problem for parents with limited living space. For this reason it is desirable that such furniture serve more than one purpose. As children mature rapidly and as their needs change as they mature, it is useful if furniture and fixtures designed for them can be used during different phases of their development. A bedside co-sleeper is very useful for an infant or very young child. However as the child grows, it will soon be desirable for him or her to have a separate bed. If the co-sleeper can then be put to other uses, the parents will save both space and the cost of other furniture. Various examples of such multi-purpose children's furniture have been patented and sold.

In U.S. Pat. No. 5,349,709, issued to Cheng teaches a folding combination playpen and baby bed having an elevated floorboard. U.S. Pat. No. 5,339,470, issued to Shamie discloses a combination foldable playpen and dressing/changing table. Mariol adds an upper level to a playpen to provide a bassinet. The short legs of the upper level are inserted into openings in the top of the vertical supports of the playpen. (U.S. Pat. No. 5,553,336). U.S. Pat. No. 2,632,186, issued to Berk et al. discloses a portable combination crib and playpen. Saldana teaches a unit designed for home and travel that may be used as a support for a playpen, bassinet or baby chair (U.S. Pat. No. 2,691, 176).

Beside cribs that attached to the parents' bed were known at the turn of the century (U.S. Pat. Nos. 5,548,005; 620,069; 1,138,451; 1,283,169; 1,267,244) but fell out of favor for many years. Recently there has been a resurgence in the practice of having babies adjacent the parents' bed. Such bed-side cribs are taught in U.S. Pat. No. 5,172,435 to Griffin et al.; U.S. Pat. Nos. 5,148,561 to Tharalson et al; and 5,293,655 to Van Winkle et al.

It is an objective of the present invention to provide an attractive piece of furniture that will serve as a sturdy bedside co-sleeper while providing alternative uses as the child matures.

It is a further objective of the invention to provide a unit that can be readily converted to a child's easel. It is still a further objective of the present invention that the unit serves as a means to store or display a child's toys. It is yet a further objective of the invention that the unit be adaptable for use with platform-style beds that are typically lower than conventional beds. It is another objective of the present invention that the legs of the unit is adjustable to provide a comfortable working height when employed as a child's easel. Finally, it is an objective of the invention that the unit be convertible from one function to another without the use of tools and that no small loose parts are required that might be swallowed by the child.

Other features and advantages of the invention will be seen from the following description and drawings.

SUMMARY OF THE INVENTION

A multi-purpose bedside co-sleeper convertibly adapted for use as a child's easel, bassinet, couch and toy storage/ display device may be constructed from the following components. A rigid enclosure that has an open top, a mattress base, first and second side walls, a back wall, and means for supporting the enclosure are provided. The mattress base has an upper surface, a lower surface, a front edge, a back edge, a first side edge and a second side edge.

The back wall is removably attached to the first and second side walls. The first and second side walls and the back wall are of sufficient height to confine a small child inside. Each of the first and second side walls have a top edge, a bottom edge, a front edge and a back edge. Means are provided for adjusting the height of the co-sleeper relative to a ground surface.

The mattress base is hingedly attached at its lower surface to the means for supporting the enclosure. Means are provided for alternatively positioning the mattress base at an acute angle to the ground surface, at a right angle to the ground surface and substantially parallel to the ground. At least one shelf is removably attached to the first and second side walls and means are provided for securing the multi-purpose bedside co-sleeper to the parental bed.

In a variant of the invention, a front retaining lip is provided. The retaining lip is fixedly attached to the front edge of the mattress base and extends from the first side wall to the second side wall and extends above the mattress base for a first predetermined distance.

A mattress pad is provided that is sized, shaped and located to removably cover the mattress base. In use, when the mattress pad is located over the mattress base the front retaining lip will prevent the mattress pad from sliding forwardly on the mattress base.

In another variant of the invention, the means for supporting the enclosure further comprises a front leg portion and a rear leg portion. The front leg portion has a top edge, a bottom edge, a first side edge, a second side edge and a first knee opening of a first predetermined height. The front leg portion is fixedly attached to the first side wall and the second side wall and is spaced inwardly from the front edge of the mattress base by a second predetermined distance.

The rear leg portion has a top edge, a bottom edge, a first side edge, a second side edge and a second knee opening of a second predetermined height. The rear leg portion is fixedly attached to the first side wall and the second side wall and is coplanar with the back wall. In use, when the enclosure is positioned in a first, lower position, the enclosure may be supported on the ground surface on the bottom edge of the front leg portion, bottom edge of the rear leg portion and the bottom edges of the first and second side walls.

In yet another variation of the invention, the means for adjusting the height of the co-sleeper relative to a ground surface further comprises front and rear leg attachment portions extending downwardly from each of the-first and second side walls. A series of first vertically spaced adjustment holes extends through each of the front and rear leg attachment portions of the first and second side walls.

Four adjustable leg members are provided, each including at least one second series of vertically spaced adjustment holes. The second series of adjustment holes is sized, shaped, and located to align with at least two of the first series of adjustment holes in each of the first and second side walls. Means are provided to removably secure each of the adjustable leg members to one of the first and second side walls. In use, when each of the adjustable leg members is secured to one of the first and second side walls in the first, lower position the enclosure will be at a height relative to the ground surface to serve as a bed-side co-sleeper, couch or toy display/storage device. When the leg members are secured to the first and second side walls in a second, higher position the enclosure will be at a height relative to the ground surface to serve as a child's easel or bassinet.

In still another variation, the means for alternatively positioning the mattress base at at least one acute angle to the ground surface, at a right angle to the ground surface and substantially parallel thereto further comprises first and second receiving openings. Each of the receiving openings is located on one of the first and second side edges of the mattress base and is spaced from its front edge. Each of the receiving openings includes a securing means.

A pair of first locating holes is provided, each of which is sized, shaped, and located to align with one of the first and second receiving openings when the mattress base is positioned at a right angle to the ground surface. At least one pair of second locating holes is provided, each of which is sized, shaped, and located to align with one of the first and second receiving openings when the mattress base is positioned at an acute right angle to the ground surface.

First and second locating means are provided, each of the locating means is sized, shaped and located to pass through one of the first and second locating holes to engage the securing means in one of the first and second receiving openings. In use, the mattress base is positioned so that the first pair of locating holes is aligned with one of the receiving openings. Each of the locating means is then passed through one of the first pair of locating holes and into one of the receiving openings. The locating means then engage the securing means and the mattress base will be removably secured at a right angle to the ground surface, thus providing a back for the toy storage/display device.

For use in an alternative mode, the mattress base is positioned so that one of the second pair of locating holes is aligned with the receiving openings. Next, each of the locating means is passed through one of the second pair of locating holes and into one of the receiving openings to engage the securing means. The mattress base will then be removably secured at an acute angle to the ground surface thus providing a suitable working surface for a child's easel.

In yet a further variation of the invention, the securing means is a female thread fixedly attached within the receiving opening. In this variation, the locating means is a bolt sized, shaped and threaded to pass though one of the locating holes in one of the first and second side walls and removably engage the securing means.

In still a further variation, the means for securing the multi-purpose bedside co-sleeper to the parental bed further comprises a strap member. The strap member has a length greater than twice the width of the parental bed and has a first end and a second end.

A resistance plate member is provided. The resistance plate has at least two slots vertically aligned and centrally located through which the strap member is threaded such that the first end and the second end are substantially equidistant from the plate member. Strap member receiving means are fixedly attached to the first and second sides of the co-sleeper adjacent their back edges.

Attachment cooperation means are slidably engaged near the first end and near the second end of the strap member for reversible connection to the strap member receiving means. Means for adjusting the length of the strap member are provided. These adjusting means also serve to tighten the strap member after connecting the attachment cooperation means to the strap member receiving means. In use, the strap member is properly positioned when it is located under the mattress of the parental bed and held in place by the resistance plate. The resistance plate is positioned vertically at the side of the parental bed opposite placement of the co-sleeper and the strap member is tightened so the co-sleeper is held fast to the parental bed.

In another variation of the invention, the co-sleeper further comprises first and second guide slots. The guide are slots sized, shaped and located in the first and second side walls adjacent their front edges to constrain the strap member adjacent its first end and its second end, thereby more securely holding the co-sleeper to the parental bed.

In still another variation, the co-sleeper further comprises a front wall. The front wall has a top edge, a bottom edge, a first side edge and a second side edge. The front wall is removably attached at its first side edge to the first side wall adjacent its front edge and removably attached at its second side edge to the second side wall adjacent its front edge. Means for removably attaching the front wall to the first and second side walls are provided. In use, when the front wall is attached to the first and second side walls its bottom edge will be located upon the front retaining lip of the mattress base and the co-sleeper will be convertibly adapted for use as a bassinet.

In yet another variation of the invention, the means for removably attaching the front wall to the first and second side walls further comprises first and second receiving slide pairs. Each of the receiving slide pairs has a top portion and a bottom portion. Each of the top and bottom portions includes a C-shaped receiving channel extending vertically for the height of each portion. Means for securing the slide pairs to the first and second side edges of the front wall are provided.

First and second guide member pairs are provided. Each of the guide member pairs has an upper portion and a lower portion. Each of the portions includes a protrusion sized, shaped and disposed to slidably engage the C-shaped receiving channel. Each of the upper portions includes a releasable retaining means and each of the upper and lower portions includes means for securing the guide member pairs to one of the first and second side walls.

In use the first and second receiving slide pairs are secured to the first and second side edges of the front wall and the first and second guide member pairs are secured to the first and second side walls adjacent their front edges. The front wall is located between the first and second side walls with the first and second guide member pairs engaging the first and second receiving slide pairs. The retaining means of the upper portions of the first and second guide member pairs secure the first and second receiving slide pairs and the front wall may be removably secured to the enclosure for use as a bassinet.

Still another variation, further comprises a base plate. The base plate has a top surface, a front edge, a back edge, a first side edge and a second side edge. The base plate extends from the front leg portion to the rear leg portion and from the first side wall to the second side wall. Means are provided for supporting the base plate adjacent to the top edge of the front leg portion and adjacent to the top edge of the rear leg portion. Means are also provided for lifting the base plate from the supporting means.

Still a further variation of the invention, further comprises a storage shelf. The storage shelf has a top surface, a front edge, a back edge, a first side edge and a second side edge. The storage shelf extends from the front leg portion to the rear leg portion and from the first side wall to the second side wall. Means are provided for supporting the storage shelf at a level spaced below and parallel to the base plate and above the second knee opening of the rear leg portion. In use, when the base plate is lifted upwardly from the enclosure items may be placed upon the storage shelf and the base plate lowered over the items, thereby retaining the items in storage within the co-sleeper.

In yet a further variation, the co-sleeper further comprises at least two sets of holes for removably securing the shelves to the first and second side walls. When the co-sleeper is utilized as a child's easel, the shelves may be located in a first position behind the angled mattress base, and when the co-sleeper is utilized as a toy storage/display device, the shelves may be located in a second position behind the upright mattress base.

In yet another variation of the invention, the co-sleeper further comprises a couch pad. The couch pad is sized, shaped and located to provide a cushioning layer between a seated person and the mattress, side walls and back wall of the co-sleeper. Means are provided for securing the couch pad upon the mattress base, side walls and back wall of the co-sleeper.

In a final variation, the co-sleeper further comprises an art supply holder. The holder is sized, shaped and located to accommodate an artist's paints, brushes, and other supplies. The art supply holder is removably attached to the front retaining lip of the mattress.

DESCRIPTION OF THE DRAWINGS

FIG. 1 is a perspective view of the preferred embodiment of the invention;

FIG. 2 is a cross-sectional side elevational view of the FIG. 1 embodiment;

FIG. 3 is a perspective view of the FIG. 1 embodiment attached to a parental bed by the safety strap assembly;

FIG. 6 is a cross-sectional side elevational view of the FIG. 1 embodiment configured as a toy storage and display device;

FIG. 7 is a perspective view of the FIG. 1 embodiment with the addition of a removable front wall;

FIG. 8 is a perspective view of the removable front wall and upper attachment connector;

FIG. 9 is a perspective view of the removable front wall and lower attachment connector;

FIG. 10 is a perspective view of the FIG. 1 embodiment with removable couch pad attached; and FIG. 11 is a cross-sectional side elevation of the threaded attachment means.

DETAILED DESCRIPTION OF THE PREFERRED EMBODIMENT

Figure 4:
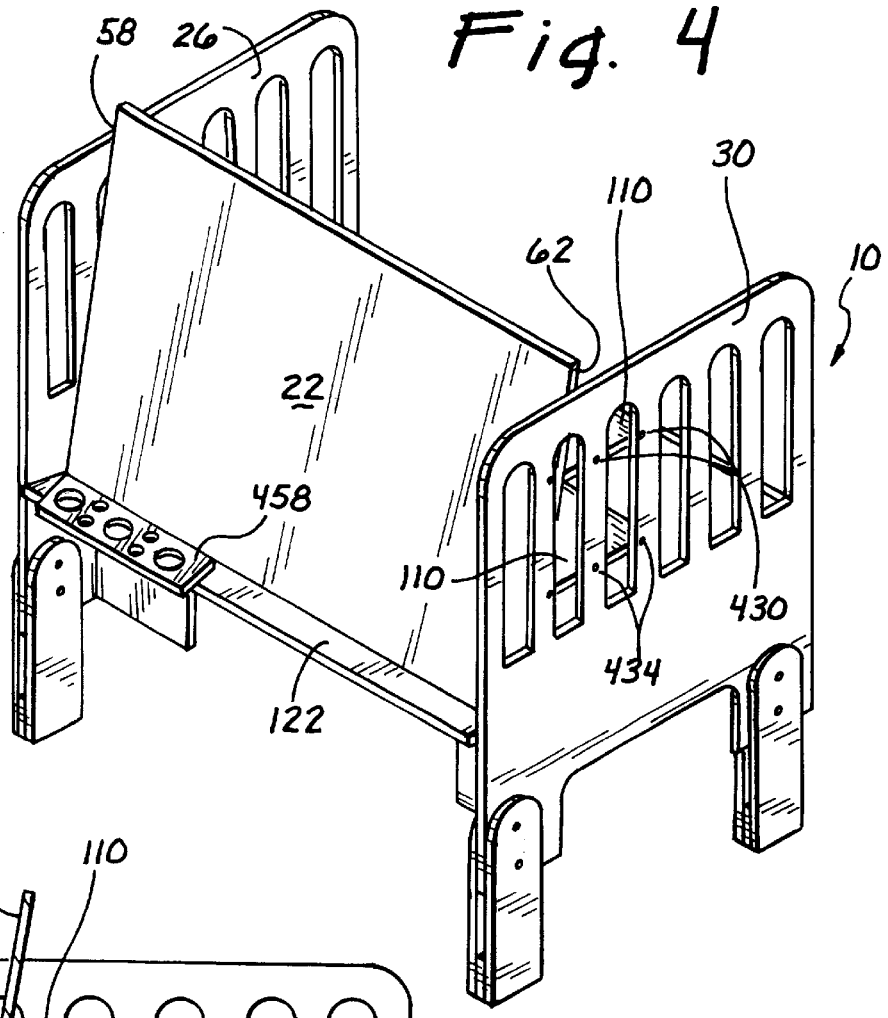
FIG. 4 is a perspective view of the FIG. 1 embodiment configured as a child's easel.

As illustrated in FIGS. 1–9, a multi-purpose bedside co-sleeper 10 convertibly adapted for use as a child's easel, bassinet, couch and toy storage/display device may be constructed from the following components. A rigid enclosure 14 that has an open top 18, a mattress base 22, first 26 and second 30 side walls, a back wall 34, and means 38 for supporting the enclosure 14 are provided. The mattress base 22 has an upper surface 42, a lower surface 46, a front edge 50, a back edge 54, a first side edge 58 and a second side edge 62.

The back wall 34 is removably attached to the first 26 and second 30 side walls. The first 26 and second 30 side walls and the back wall 34 are of sufficient height to confine a small child inside. Each of the first 26 and second 30 side walls have a top edge 66, 70, a bottom edge 74, 78, a front edge 82, 86 and a back edge 90, 94. Means 98 are provided for adjusting the height of the co-sleeper 10 relative to a ground surface 102.

The mattress base 22 is hingedly attached at its lower surface 46 to the means 38 for supporting the enclosure 14. Means 106 are provided for alternatively positioning the mattress base 22 at an acute angle to the ground surface 102, at a right angle to the ground surface 102 and substantially parallel to the ground 102. At least one shelf 110 is removably attached to the first 26 and second 30 side walls and means 114 are provided for securing the multi-purpose bedside co-sleeper 10 to a parental bed 118.

In a variant of the invention, a front retaining lip 122 is provided. The retaining lip 122 is fixedly attached to the front edge 50 of the mattress base 22 and extends from the first side wall 26 to the second side wall 30 and extends above the mattress base 22 for a first predetermined distance 126.

A mattress pad 130 is provided that is sized, shaped and located to removably cover the mattress base 22. In use, when the mattress pad 130 is located over the mattress base 22 the front retaining lip 122 will prevent the mattress pad 130 from sliding forwardly on the mattress base 22.

In another variant of the invention, the means 38 for supporting the enclosure 14 further comprises a front leg portion 134 and a rear leg portion 138. The front leg portion 134 has a top edge 142, a bottom edge 146, a first side edge 150, a second side edge 154 and a first knee opening 158 of a first predetermined height 162. The front leg portion 134 is fixedly attached to the first side wall 26 and the second side wall 30 and is spaced inwardly from the front edge 50 of the mattress base 22 by a second predetermined distance 166.

The rear leg portion 138 has a top edge 170, a bottom edge 174, a first side edge (not shown), a second side edge (not shown) and a second knee opening 186 of a second predetermined height 190. The rear leg portion 138 is fixedly attached to the first side wall 26 and the second side wall 30 and is coplanar with the back wall 34. In use, when the enclosure 14 is positioned in a first, lower position, the enclosure 14 may be supported on the ground surface 102 on the bottom edge 146 of the front leg portion 134, bottom edge 174 of the rear leg portion 138 and the bottom edges 74, 78 of the first 26 and second 30 side walls.

In yet another variation of the invention, the means 98 for adjusting the height of the co-sleeper 10 relative to a ground surface 102 further comprises front 194 and rear 198 leg attachment portions extending downwardly from each of the first 26 and second 30 side walls. A series of first 202 vertically spaced adjustment holes extends through each of the front 194 and rear 198 leg attachment portions of the first 26 and second 30 side walls.

Four adjustable leg members 206 are provided, each including at least one second 210 series of vertically spaced adjustment holes. The second 210 series of adjustment holes is sized, shaped, and located to align with at least two of the first 202 series of adjustment holes in each of the first 26 and second 30 side walls. Means 214 are provided to removably secure each of the adjustable leg members 206 to one of the first 26 and second 30 side walls. In use, when each of the adjustable leg members 206 is secured to one of the first 26 and second 30 side walls in the first, lower position the enclosure 14 will be at a height relative to the ground surface 102 to serve as a bed-side co-sleeper, couch or toy display/storage device. When the leg members 206 are secured to the first 26 and second 30 side walls in a second, higher position the enclosure 14 will be at a height relative to the ground surface 102 to serve as a child's easel or bassinet.

In still another variation, the means 106 for alternatively positioning the mattress base 22 at at least one acute angle to the ground surface 102, at a right angle to the ground surface 102 and substantially parallel thereto further comprises first and second receiving openings (not shown). Each of the receiving openings is located on one of the first 58 and second 62 side edges of the mattress base 22 and is spaced from its front edge 50. Each of the receiving openings includes a securing means 226 (see FIG. 11).

A pair of first locating holes 230 is provided, each of which is sized, shaped, and located to align with one of the first and second receiving openings when the mattress base 22 is positioned at a right angle to the ground surface 102. At least one pair of second locating holes 234 is provided, each of which is sized, shaped, and located to align with one of the first and second receiving openings when the mattress base 22 is positioned at an acute right angle to the ground surface 102.

First and second locating means (not shown) are provided, each of the locating means is sized, shaped and located to pass through one of the first 230 and second 234 locating holes to engage the securing means 226 in one of the first and second receiving openings. In use, the mattress base 22 is positioned so that the first pair of locating holes 230 is aligned with one of the receiving openings. Each of the locating means is then passed through one of the first pair of locating holes 230 and into one of the receiving openings. The locating means then engage the securing means 226 and the mattress base 22 will be removably secured at a right angle to the ground surface 102, thus providing a back for the toy storage/display device.

For use in an alternative mode, the mattress base 22 is positioned so that one of the second pair of locating holes 234 is aligned with the receiving openings. Next, each of the locating means is passed through one of the second 234 pair of locating holes and into one of the receiving openings to engage the securing means 226. The mattress base 22 will then be removably secured at an acute angle to the ground surface 102 thus providing a suitable working surface for a child's easel as illustrated in FIG. 4.

In yet a further variation of the invention, the securing means 226 is a female thread 246 fixedly attached within the receiving opening. In this variation, the locating means is a bolt 250 sized, shaped and threaded to pass though one of the locating holes 230, 234 in one of the first 26 and second 30 side walls and removably engage the securing means 226 (see FIG. 11).

In still a further variation, as illustrated in FIGS. 1 and 3, the means 114 for securing the multi-purpose bedside co-sleeper 10 to the parental bed 118 further comprises a strap member 254. The strap member 254 has a length greater than twice the width of the parental bed 118 and has a first end (not shown) and a second end 262. A resistance plate member 266 is provided. The resistance plate 266 has at least two slots 270 vertically aligned and centrally located through which the strap member 254 is threaded such that the first end and the second end 262 are substantially equidistant from the plate member 266. Strap member receiving means 274 are fixedly attached to the first 26 and second 30 sides of the co-sleeper adjacent their back edges 90, 94.

Attachment cooperation means 278 are slidably engaged near the first end and near the second end 262 of the strap member 254 for reversible connection to the strap member receiving means 274. Means 280 for adjusting the length of the strap member 254 are provided. These adjusting means 280 also serve to tighten the strap member 254 after connecting the attachment cooperation means 278 to the strap member receiving means 274. In use, the strap member 254 is properly positioned when it is located under the mattress of the parental bed 118 and held in place by the resistance plate 266. The resistance plate 266 is positioned vertically at the side of the parental bed 118 opposite placement of the co-sleeper 10 and the strap member 254 is tightened so the co-sleeper 10 is held fast to the parental bed 118.

In another variation of the invention, the co-sleeper 10 further comprises first 282 and second 286 guide slots. The guide slots 282, 286 are sized, shaped and located in the first 26 and second 30 side walls adjacent their front edges 82, 86 to constrain the strap member 254 adjacent its first end 258 and its second end 262, thereby more securely holding the co-sleeper 10 to the parental bed 118.

In still another variation, illustrated in FIG. 7, the co-sleeper 10 further comprises a front wall 290. The front wall 290 has a top edge 294, a bottom edge 298, a first side edge 302 and a second side edge 306. The front wall 290 is removably attached at its first side edge 302 to the first side wall 26 adjacent its front edge 82 and removably attached at its second side edge 306 to the second side wall 30 adjacent its front edge 86. Means 310 for removably attaching the front wall 290 to the first 26 and second 30 side walls are provided. In use, when the front wall 290 is attached to the first 26 and second 30 side walls its bottom edge 298 will be located upon the front retaining lip 122 of the mattress base 22 and the co-sleeper 10 will be convertibly adapted for use as a bassinet.

In yet another variation of the invention, as illustrated in FIGS. 7, 8 and 9, the means 310 for removably attaching the front wall 290 to the first 26 and second 30 side walls further comprises first 314 and second 318 receiving slide pairs. Each of the receiving slide pairs 314, 318 has a top portion 322 and a bottom portion 326. Each of the top 322 and bottom 326 portions includes a C-shaped receiving channel 330 extending vertically for the height of each portion 322, 326. Means (not shown) for securing the slide pairs 314, 318 to the first 302 and second 306 side edges of the front wall 290 are provided.

First 346 and second 350 guide member pairs are provided. Each of the guide member pairs 346, 350 has an upper portion 348 and a lower portion 352. Each of the portions 348, 252 includes a protrusion 356 sized, shaped and disposed to slidably engage the C-shaped receiving channel 330. Each of the upper portions 348 includes a releasable retaining means 358 and each of the upper 348 and lower 352 portions includes means 362 for securing the guide member pairs 346, 350 to one of the first 26 and second 30 side walls.

In use the first 314 and second 318 receiving slide pairs are secured to the first 302 and second 306 side edges of the front wall 290 and the first 346 and second 350 guide member pairs are secured to the first 26 and second 30 side walls adjacent their front edges 82, 86. The front wall 290 is located between the first 26 and second 30 side walls with the first 346 and second 350 guide member pairs engaging the first 314 and second 318 receiving slide pairs. The retaining means 358 of the upper portions 348 of the first 346 and second 350 guide member pairs secure the first 314 and second 318 receiving slide pairs and the front wall 290 may be removably secured to the enclosure 14 for use as a bassinet.

Figure 5:
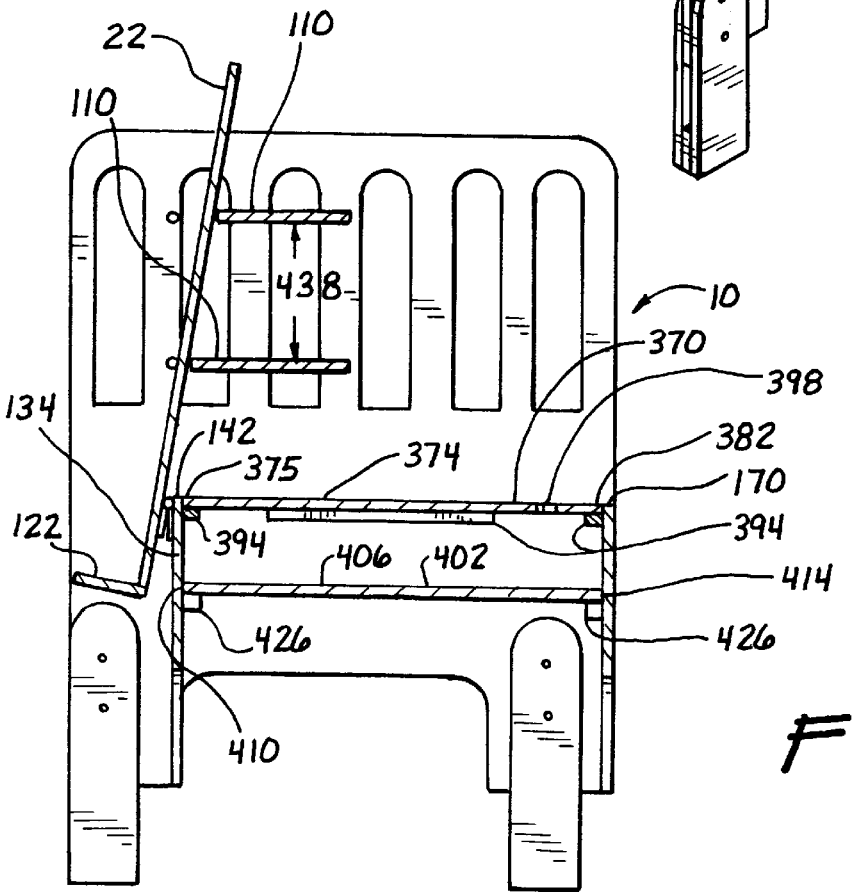
FIG. 5 is a cross-sectional side elevational view of the FIG. 4 embodiment.

Still another variation, as illustrated in FIGS. 5 and 6, further comprises a base plate 370. The base plate 370 has a top surface 374, a front edge 378, a back edge 382, a first side edge (not shown) and a second side edge (not shown). The base plate 370 extends from the front leg portion 134 to the rear leg portion 138 and from the first side wall 26 to the second side wall 30. Means 394 are provided for supporting the base plate 370 adjacent to the top edge 142 of the front leg portion 134 and adjacent to the top edge 170 of the rear leg portion 138. Means 398 are also provided for lifting the base plate 370 from the supporting means 394.

Still a further variation of the invention, as illustrated in FIGS. 5 and 6, further comprises a storage shelf 402. The storage shelf 402 has a top surface 406, a front edge 410, a back edge 414, a first side edge (sot shown) and a second side edge (not shown). The storage shelf 402 extends from the front leg portion 134 to the rear leg portion 138 and from the first side wall 26 to the second side wall 30. Means 426 are provided for supporting the storage shelf 402 at a level spaced below and parallel to the base plate 370 and above the second knee opening 186 of the rear leg portion 138. In use, when the base plate 370 is lifted upwardly from the enclosure 14 items may be placed upon the storage shelf 402 and the base plate 370 lowered over the items, thereby retaining the items in storage within the co-sleeper 10.

In yet a further variation, as illustrated in FIGS. 4, 5 and 6 the co-sleeper 10 further comprises at least two sets of holes 430, 434 for removably securing the shelves 110 to the first 26 and second 30 side walls. When the co-sleeper 10 is utilized as a child's easel, the shelves 110 may be located in a first position 438 behind the angled mattress base 22 (FIG. 5), and when the co-sleeper 10 is utilized as a toy storage/display device, the shelves 110 may be located in a second position 442 behind the upright mattress base 22 (FIG. 6).

In yet another variation of the invention, as illustrated in FIG. 10, the co-sleeper 10 further comprises a couch pad 446. The couch pad 446 is sized, shaped and located to provide a cushioning layer between a seated person 450 and the mattress 130, side walls 26, 30 and back wall 34 of the co-sleeper 10. Means (not shown) are provided for securing the couch pad 446 upon the mattress 130, side walls 26, 30 and back wall 34 of the co-sleeper 10.

In a final variation as illustrated in FIG. 4, the co-sleeper 10 further comprises an art supply holder 458. The holder 458 is sized, shaped and located to accommodate an artist's paints, brushes, and other supplies. The art supply holder 458 is removably attached to the front retaining lip 122 of the mattress base 22.

While one embodiment of the multi-purpose bedside co-sleeper convertibly adapted for use as a child's easel, bassinet, couch and toy storage/display device 10 has been illustrated and described in detail, it is to be understood that this invention is not limited thereto and may be otherwise practiced within the scope of the following claims.

What is claimed is:

1. A multi-purpose bedside co-sleeper convertibly adapted for use as a child's easel, bassinet, couch and toy storage/display device comprising:

a rigid enclosure having an open top, a mattress base, first and second side walls, a back wall, and means for supporting the enclosure;

said mattress base having an upper surface, a lower surface, a front edge, a back edge, a first side edge and a second side edge;

said back wall being removably attached to said first and second side walls;

said first and second side walls and said back wall being of sufficient height to confine a small child therewithin;

each of said first and second side walls having a top edge, a bottom edge, a front edge and a back edge;

means for adjusting the height of the co-sleeper relative to a ground surface;

said mattress base being hingedly attached at its lower surface to the means for supporting the enclosure to pivot within the enclosure;

means for alternatively positioning said mattress base within the enclosure at an acute angle to the ground surface, at a right angle to the ground surface and substantially parallel thereto; and at least one shelf removably attached to the first and second side walls; and means for securing the multi-purpose bedside co-sleeper to the parental bed.

2. A multi-purpose bedside co-sleeper convertibly adapted for use as a child's easel, bassinet, couch and toy storage/display device as described in claim 1, further comprising:

a front retaining lip, said retaining lip being fixedly attached to the front edge of the mattress base and extending from the first side wall to the second side wall and extending above the mattress base for a first predetermined distance;

a mattress pad, said mattress pad sized, shaped and disposed to removably cover the mattress base; and whereby, when the mattress pad is disposed over the mattress base the front retaining lip will prevent the mattress pad from sliding forwardly on the mattress base.

3. A multi-purpose bedside co-sleeper convertibly adapted for use as a child's easel, bassinet, couch and toy storage/display device as described in claim 1, wherein the means for supporting the enclosure further comprises:

a front leg portion, said front leg portion having a top edge, a bottom edge, a first side edge, a second side edge and a first knee opening of a first predetermined height;

said front leg portion being fixedly attached to said first side wall and said second side wall and being spaced inwardly from the front edge of the mattress base by a second predetermined distance;

a rear leg portion, said rear leg portion having a top edge, a bottom edge, a first side edge, a second side edge and a second knee opening of a second predetermined height;

said rear leg portion being fixedly attached to said first side wall and said second side wall and being coplanar with said back wall; and whereby, when the enclosure is positioned in a first, lower position, the enclosure may be supported on the ground surface on the bottom edge of the front leg portion, bottom edge of the rear leg portion and the bottom edges of the first and second side walls.

4. A multi-purpose bedside co-sleeper convertibly adapted for use as a child's easel, bassinet, couch and toy storage/display device as described in claim 1 wherein the means for adjusting the height of the co-sleeper relative to a ground surface further comprises:

front and rear leg attachment portions extending downwardly from each of the first and second side walls;

a series of first vertically spaced adjustment holes extending through each of the front and rear leg attachment portions of the first and second side walls;

four adjustable leg members, each of said leg members including at least one second series of vertically spaced adjustment holes, said second series of adjustment holes being sized, shaped, and disposed to align with at least two of the first series of adjustment holes in each of the first and second side walls;

means to removably secure each of the adjustable leg members to one of the first and second side walls; and whereby, when each of the adjustable leg members is secured to one of the first and second side walls in the first, lower position the enclosure will be at a height relative to the ground surface to serve as a bed-side co-sleeper, couch or toy display/storage device, and when the leg members are secured to the first and second side walls in a second, higher position the enclosure will be at a height relative to the ground surface to serve as a child's easel or bassinet.

5. A multi-purpose bedside co-sleeper convertibly adapted for use as a child's easel, bassinet, couch and toy storage/display device as described in claim 1 wherein the means for alternatively positioning the mattress base at at least one acute angle to the ground surface, at a right angle to the ground surface and substantially parallel thereto further comprises:

first and second receiving openings, each of said openings disposed on one of the first and second side edges of the mattress base and spaced from the front edge thereof;

each of said receiving openings including a securing means;

a pair of first locating holes, each of said first locating holes being sized, shaped, and disposed to align with one of the first and second receiving openings when the mattress base is positioned at a right angle to the ground surface;

at least one pair of second locating holes, each of said second locating holes being sized, shaped, and disposed to align with one of the first and second receiving openings when the mattress base is positioned at an acute right angle to the ground surface;

first and second locating means, each of said locating means sized, shaped and disposed to pass through one of the first and second locating holes to engage the securing means in one of the first and second receiving openings;

whereby, when the mattress base is positioned so that the first pair of locating holes is aligned with one of the receiving openings and each of the locating means is passed through one of the first pair of locating holes and into one of the receiving openings to engage the securing means, the mattress base will be removably secured at a right angle to the ground surface thus providing a back for the toy storage/display device; and whereby, when the mattress base is positioned so that one of the second pair of locating holes is aligned with the receiving openings and each of the locating means is passed through one of the second pair of locating holes and into one of the receiving openings to engage the securing means, the mattress base will be removably secured at an acute angle to the ground surface thus providing a suitable working surface for a child's easel.

6. A multi-purpose bedside co-sleeper convertibly adapted for use as a child's easel, bassinet, couch and toy storage/display device as described in claim 5 wherein the securing means is a female thread fixedly attached within the receiving opening and the locating means is a bolt sized, shaped and threaded to pass though one of the locating holes in one of the first and second side walls and removably engage the securing means.

7. A multi-purpose bedside co-sleeper convertibly adapted for use as a child's easel, bassinet, couch and toy storage/display device as described in claim 1 wherein the means for securing the multi-purpose bedside co-sleeper to the parental bed further comprises:

a strap member of a length greater than twice the width of the parental bed and having a first end and a second end;

a resistance plate member having at least two slots vertically aligned and centrally disposed through which the strap members is threaded such that the first end and the second end are substantially equidistant from the plate member;

strap member receiving means fixedly attached to the first and second sides of the co-sleeper adjacent their back edges;

attachment cooperation means slidably engaged near the first end and near the second end of the strap member for reversible connection to the strap member receiving means;

means for adjusting the length of the strap member and fixedly tightening same after connecting the attachment cooperation means to the strap member receiving means; and wherein the strap member is properly positioned when disposed under the mattress of the parental bed and held in place by the resistance plate disposed vertically at the side of the parental bed opposite placement of the co-sleeper and the strap member is tightened so the co-sleeper is held fast to the parental bed.

8. A multi-purpose bedside co-sleeper convertibly adapted for use as a child's easel, bassinet, couch and toy storage/display device as described in claim 7, further comprising:

first and second guide slots, said guide slots sized, shaped and disposed in the first and second side walls adjacent the front edges thereof to constrain the strap member adjacent its first end and its second end, thereby more securely holding the co-sleeper to the parental bed.

9. A multi-purpose bedside co-sleeper convertibly adapted for use as a child's easel, bassinet, couch and toy storage/display device as described in claim 2, further comprising:

a front wall, said front wall having a top edge, a bottom edge, a first side edge and a second side edge;

said front wall being removably attached at its first side edge to the first side wall adjacent the front edge thereof and removably attached at its second side edge to the second side wall adjacent the front edge thereof;

means for removably attaching said front wall to the first and second side walls; and whereby, when the front wall is attached to the first and second side walls its bottom edge will be disposed upon the front retaining lip of the mattress base and the co-sleeper will be convertibly adapted for use as a bassinet.

10. A multi-purpose bedside co-sleeper convertibly adapted for use as a child's easel, bassinet, couch and toy storage/display device as described in claim 9, wherein, means for removably attaching said front wall to the first and second side walls further comprises:

first and second receiving slide pairs, each of said receiving slide pairs having a top portion and a bottom portion, each of said top and bottom portions including a C-shaped receiving channel extending vertically for the height of each portion, and means for securing the slide pairs to a the first and second side edges of the front wall;

first and second guide member pairs, each of said guide member pairs having an upper portion and a lower portion, each of said portions including a protrusion sized, shaped and disposed to slidably engage said C-shaped receiving channel, each of said upper portions including a releasable retaining means and each of said upper and lower portions including means for securing the guide member pairs to one of the first and second side walls; and whereby, when the first and second receiving slide pairs are secured to the first and second side edges of the front wall and the first and second guide member pairs are secured to the first and second side walls adjacent their front edges, and front wall is disposed between the first and second side walls with the first and second guide member pairs engaging the first and second receiving slide pairs, and the retaining means of the upper portions of the first and second guide member pairs securing the first and second receiving slide pairs, the front wall may be removably secured to the enclosure for use as a bassinet.

11. A multi-purpose bedside co-sleeper convertibly adapted for use as a child's easel, bassinet, couch and toy storage/display device as described in claim 3, further comprising:

a base plate, said base plate having a top surface, a front edge, a back edge, a first side edge and a second side edge;

said base plate extending from the front leg portion to the rear leg portion and from the first side wall to the second side wall;

means for supporting said base plate adjacent to the top edge of the front leg portion and adjacent to the top edge of the rear leg portion; and means for lifting the base plate from the supporting means.

12. A multi-purpose bedside co-sleeper convertibly adapted for use as a child's easel, bassinet, couch and toy storage/display device as described in claim 3, further comprising:

a storage shelf, said storage shelf having a top surface, a front edge, a back edge, a first side edge and a second side edge;

said storage shelf extending from the front leg portion to the rear leg portion and from the first side wall to the second side wall; and means for supporting said storage shelf at a level spaced below and parallel to the base plate and above the second knee opening of the rear leg portion; and whereby, when the base plate is lifted upwardly from the enclosure items may be placed upon the storage shelf and the base plate lowered thereover, thereby retaining said items in storage within the co-sleeper.

13. A multi-purpose bedside co-sleeper convertibly adapted for use as a child's easel, bassinet, couch and toy storage/display device as described in claim 1, further comprising:

at least two sets of holes for removably securing the shelves to the first and second side walls; and whereby, when the co-sleeper is utilized as a child's easel, the shelves may be disposed in a first position behind the angled mattress base, and when the co-sleeper is utilized as a toy storage/display device, the shelves may be disposed in a second position behind the upright mattress base.

14. A multi-purpose bedside co-sleeper convertibly adapted for use as a child's easel, bassinet, couch and toy storage/display device as described in claim 1, further comprising:

a couch pad, said couch pad being sized, shaped and disposed to provide a cushioning layer between a seated person and the mattress, side walls and back wall of the co-sleeper; and means for securing the couch pad upon the mattress, side walls and back wall of the co-sleeper.

15. A multi-purpose bedside co-sleeper convertibly adapted for use as a child's easel, bassinet, couch and toy storage/display device as described in claim 1, further comprising:

an art supply holder, said holder sized, shaped and disposed to accommodate an artist's paints, brushes, and other supplies; and said art supply holder removably attached to the front retaining lip of the mattress base.

* * * * *

UNITED STATES PATENT AND TRADEMARK OFFICE

CERTIFICATE OF CORRECTION

PATENT NO. : 6,112,347
APPLICATION NO. : 09/244140
DATED : September 5, 2000
INVENTOR(S) : Douglas E. Tharalson and Diana M. Tharalson It is certified that error appears in the above-identified patent and that said Letters Patent is hereby corrected as shown below:

On the title page: Item [63] Please correct the related U.S. Application Data and Column 1, between lines 3-4, to read:

This application claims benefit under 35 U.S.C. 120 as a continuation-in-part of PCT Application PCT/US97/15282, entitled Multiple-Purpose Convertible Playpen, having inventors Douglas E. Tharalson and Diana M. Tharalson, and designating the United States; which in turn claims priority to United States Patent No. 5,845,349, entitled MULTIPLE PURPOSE CONVERTIBLE PLAYPEN and having inventors Douglas E. Tharalson and Diana M. Tharalson.

Signed and Sealed this

Twelfth Day of June, 2007

JON W. DUDAS
*Director of the United States Patent and Trademark Office*